US009918889B2

(12) United States Patent
Pinus

(10) Patent No.: US 9,918,889 B2
(45) Date of Patent: Mar. 20, 2018

(54) DISPOSABLE BEDPAN

(71) Applicant: Sircare, LLC., Aventura, FL (US)

(72) Inventor: Gustavo Guillermo Pinus, Buenos Aires (AR)

( * ) Notice: Subject to any disclaimer, the term of this patent is extended or adjusted under 35 U.S.C. 154(b) by 11 days.

(21) Appl. No.: 14/965,119

(22) Filed: Dec. 10, 2015

(65) Prior Publication Data

US 2017/0165140 A1 Jun. 15, 2017

(51) Int. Cl.
*A61G 9/00* (2006.01)

(52) U.S. Cl.
CPC ..... *A61G 9/003* (2013.01)

(58) Field of Classification Search
USPC ..... 4/451, 450
See application file for complete search history.

(56) References Cited

U.S. PATENT DOCUMENTS

| | | | | |
|---|---|---|---|---|
| 3,460,164 | A * | 8/1969 | Patton | A61G 9/003 4/451 |
| 3,599,249 | A * | 8/1971 | Reed | A61G 9/003 4/451 |
| 6,351,858 | B1 | 3/2002 | Toia | |
| 2010/0306913 | A1* | 12/2010 | Zazzara | A61G 9/003 4/451 |
| 2011/0185489 | A1* | 8/2011 | Partington | A61G 9/003 4/450 |

* cited by examiner

*Primary Examiner* — Lauren Crane
(74) *Attorney, Agent, or Firm* — Albert Bordas, P.A.

(57) ABSTRACT

A disposable bedpan having a bedpan with a base and a sidewall. The sidewall has at least one lateral support. A cover has a cover base. The cover mounts upon the bedpan when assembled to support a user thereon. The bedpan collects human waste. The bedpan and the cover are for a single use, thus disposable. A plurality of the bedpan is stackable upon one another, and a plurality of the cover is stackable upon one another to be volumetrically efficient for carrying, transporting, and/or storage.

3 Claims, 5 Drawing Sheets

DISPOSABLE BEDPAN

BACKGROUND OF THE INVENTION

1. Field of the Invention

The present invention relates to bedpans, and more particularly, to disposable bedpans.

2. Description of the Related Art

Applicant believes that one of the closest references corresponds to U.S. Pat. No. 6,351,858 issued to Mario Fernando Toia on Mar. 5, 2002 for a Disposable Container for Collecting Human Wastes and a Container-Grinding Machine. However, it differs from the present invention because Toia teaches a process for disposing of human waste in an efficient and environmentally or pathologically safe manner, a grindable container for collecting human waste and a crushing machine for said containers. The container is made of a grindable, biodegradable material such as cellulose pulp and is designed to hold human waste without any leaks or cracks. The container is formed by an upper portion and a lower portion, both comprising corresponding snap-in peripheral engaging flanges for engaging one to the other without the use of gluing products and comprising an anti-slipping surface finish for avoiding slippage of the container during usage and designed for comfortable human skin contact. The crushing machine is designed to be used at any health-care or rest-home center and is adequate for dumping the final product into a sewer system in an environmental caring manner.

Other patents describing the closest subject matter provide for a number of more or less complicated features that fail to solve the problem in an efficient and economical way. None of these patents suggest the novel features of the present invention.

SUMMARY OF THE INVENTION

The instant invention is a disposable bedpan, comprising a bedpan having a base and a sidewall with at least one lateral support, and a cover comprising a cover base. The cover mounts upon the bedpan when assembled to support a user thereon. The bedpan collects human waste. The bedpan and the cover are for a single use, thus disposable. A plurality of the bedpan is stackable upon one another, and a plurality of the cover is stackable upon one another.

The bedpan further comprises a top ridge and a front ridge. A front top cavity defined between the top ridge and the front ridge. The base comprises at least one ridge that extends perpendicularly across the base. The at least one lateral support protrudes inwardly from the sidewall. Each of the at least one lateral support is tapered from the base towards the top ridge. The bedpan further comprises a front base support. The bedpan further comprises a front bottom cavity defined between the base and the front base support, a base support.

The cover base comprises at least one cover ridge that extends perpendicularly across the cover base. The cover further comprises a cover front ridge. The cover further comprises a cover front top cavity defined between the cover front ridge and the cover base. The cover further comprises a cover cavity defined by a cover base support, and a cover base ridge.

It is therefore one of the main objects of the present invention to provide a disposable bedpan comprising a bedpan and a cover.

It is another object of this invention to provide a disposable bedpan, whereby the bedpans and covers are stackable.

It is another object of this invention to provide a disposable bedpan that sustains the weight of a user there It is another object of this invention to provide a disposable bedpan that is volumetrically efficient for carrying, transporting, and storage.

It is another object of this invention to provide a disposable bedpan that can be readily assembled and disassembled without the need of any special tools.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
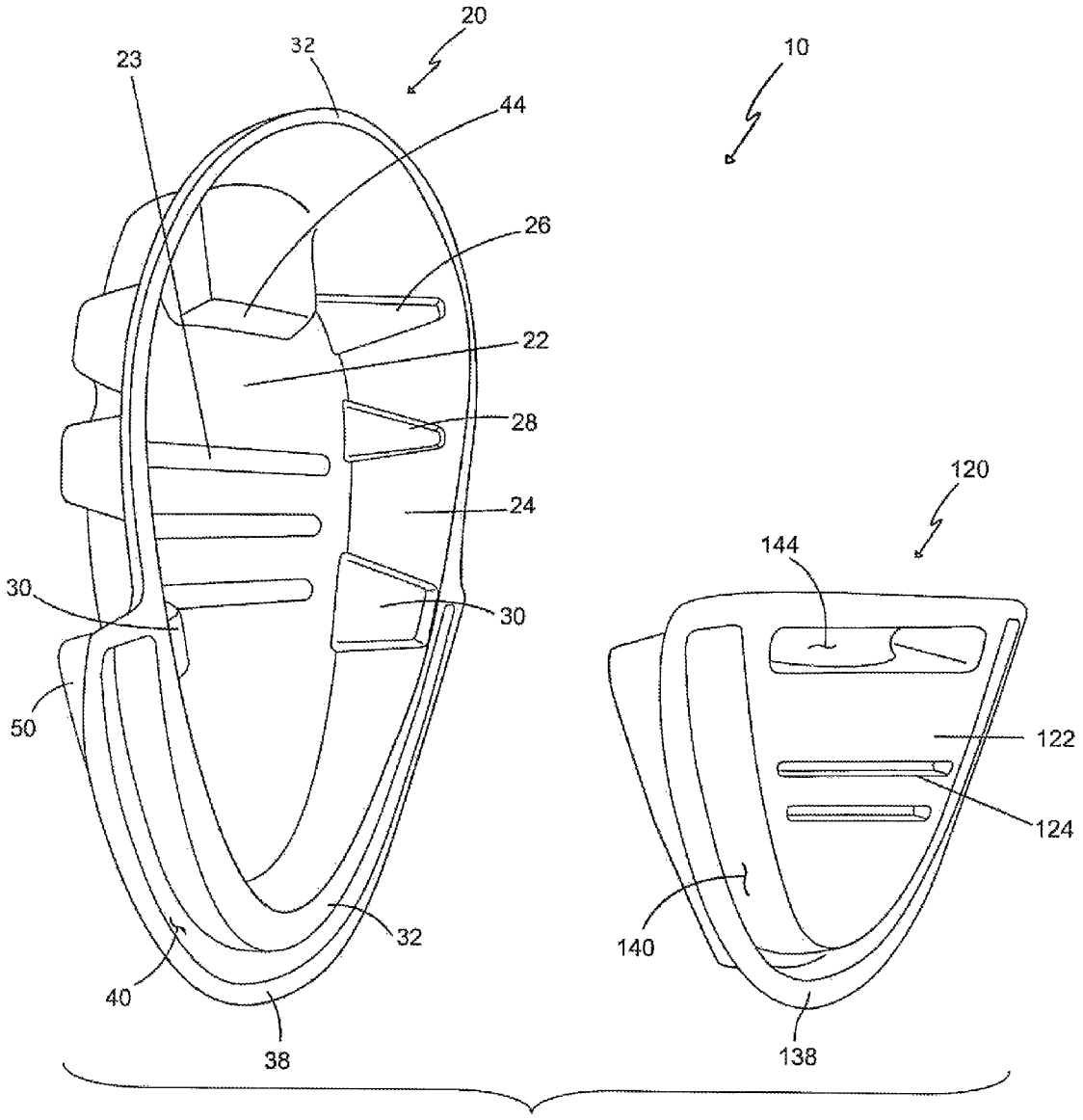
FIG. 1 represents a top isometric view of a disassembled disposable bedpan.

Referring now to the drawings, the present invention is a disposable bedpan and is generally referred to with numeral 10. It can be observed that it basically includes bedpan 20 and cover 120.

Figure 2:
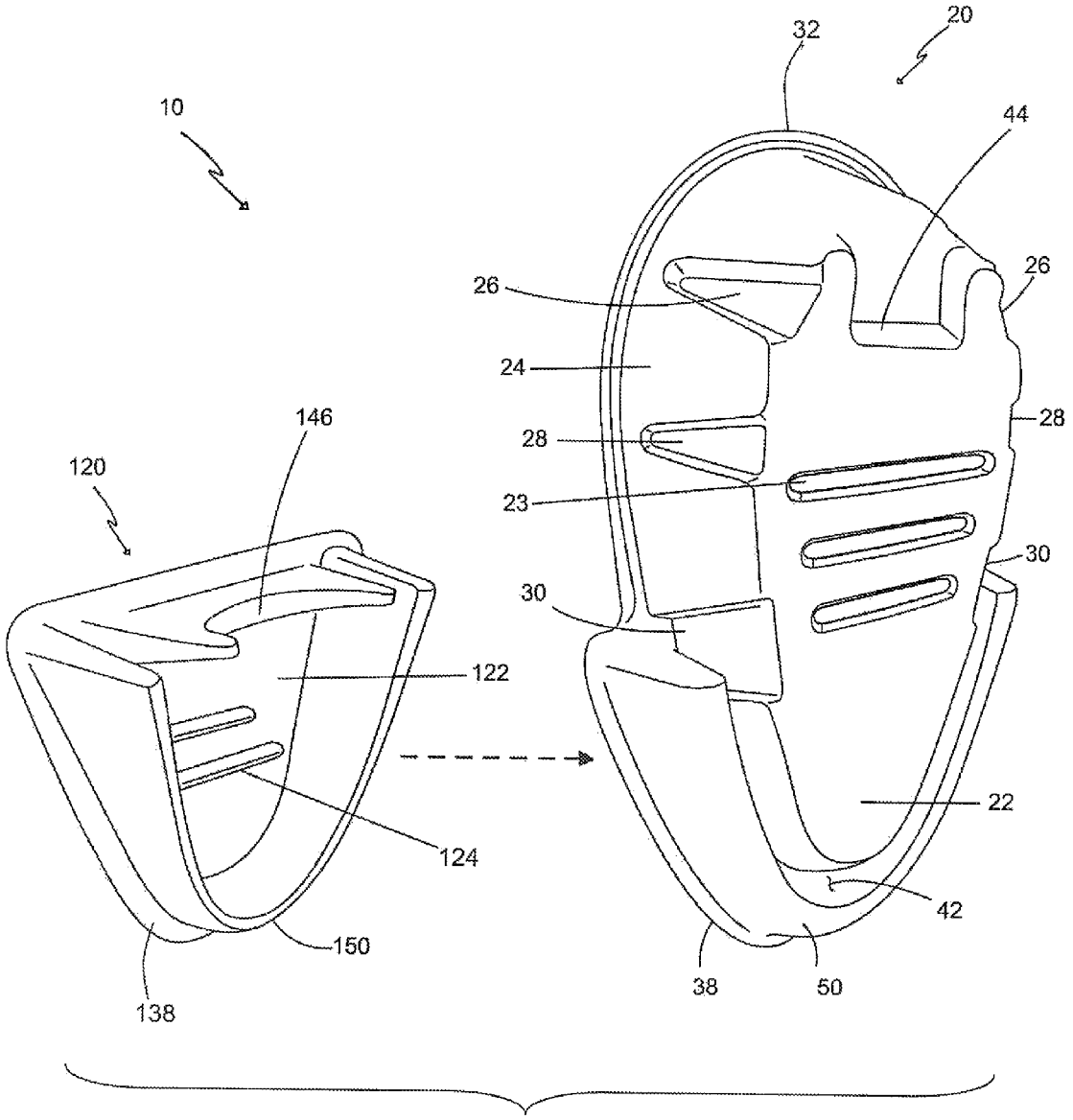
FIG. 2 represents a bottom isometric view of the disassembled disposable bedpan.

As seen in FIGS. 1 and 2, disposable bedpan 10 comprises bedpan 20 having base 22 and sidewall 24 with at least one lateral support. In a preferred embodiment, bedpan 20 is generally oval in shape. In a preferred embodiment, bedpan 20 is symmetrical, whereby sidewall 24 has a set of each lateral supports 26, 28, and 30 on its longitudinal sides. Bedpan 20 further comprises top ridge 32 and front ridge 38. Each lateral supports 26, 28, and 30 protrude inwardly from sidewall 24, and are tapered from base 22 towards top ridge 32. Base 22 comprises at least one ridge 23. Each ridge 23 extends perpendicularly across base 22. In a preferred embodiment, ridges 23 protrude inwardly from base 22. Front top cavity 40 is defined between top ridge 32 and front ridge 38. Front ridge 38 contours and extends along a perimeter section of top ridge 32. Bedpan 20 further comprises front base support 50. Front bottom cavity 42 is defined between base 22 and front base support 50. Bedpan 20 further comprises base support 44.

Disposable bedpan 10 also comprises cover 120 having cover base 122 with at least one cover ridge 124 that extends perpendicularly across cover base 122. Cover 120 further comprises cover front ridge 138. Cover 120 further comprises cover front top cavity 140 defined between cover front ridge 138 and cover base 122. Cover 120 has cover cavity 144 defined by cover base support 146, and cover base ridge 150. Cover base support 146 forms an arch. In a preferred embodiment, cover 120 is symmetrical.

Figure 3:
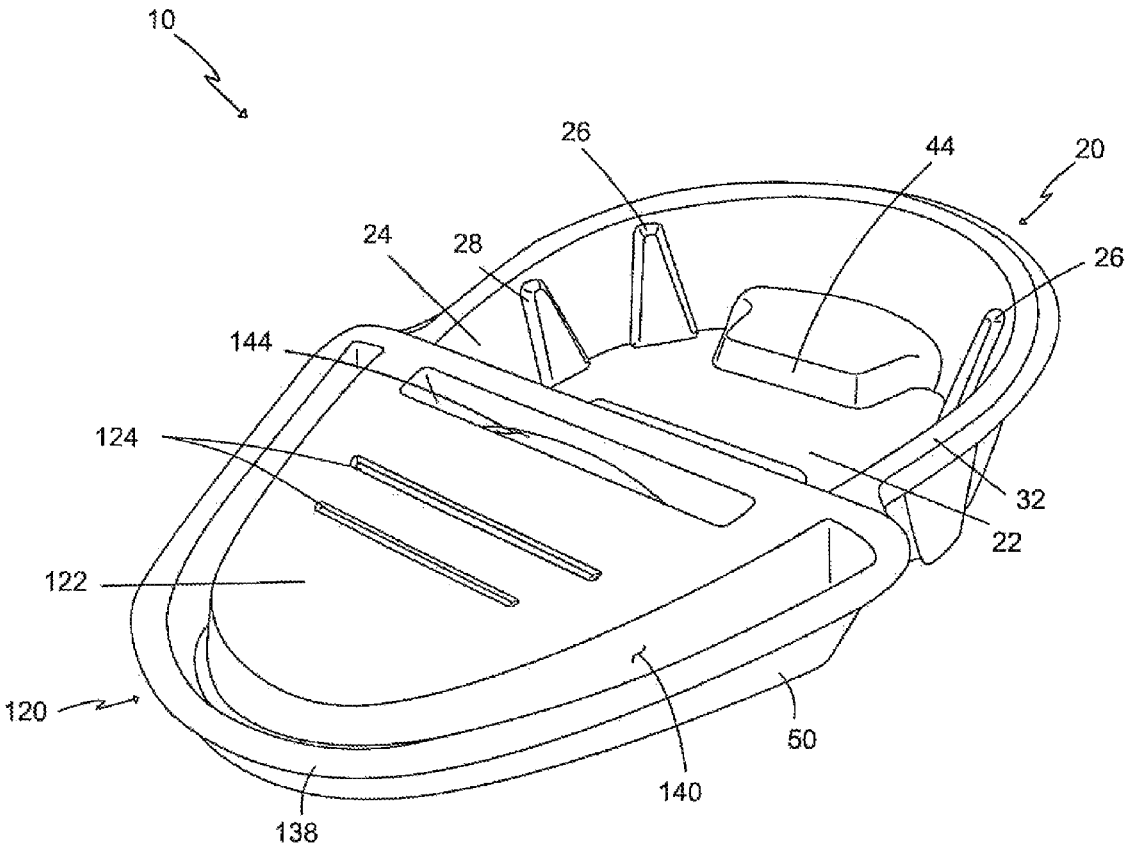
FIG. 3 represents a first isometric view of an assembled disposable bedpan.
Figure 4:
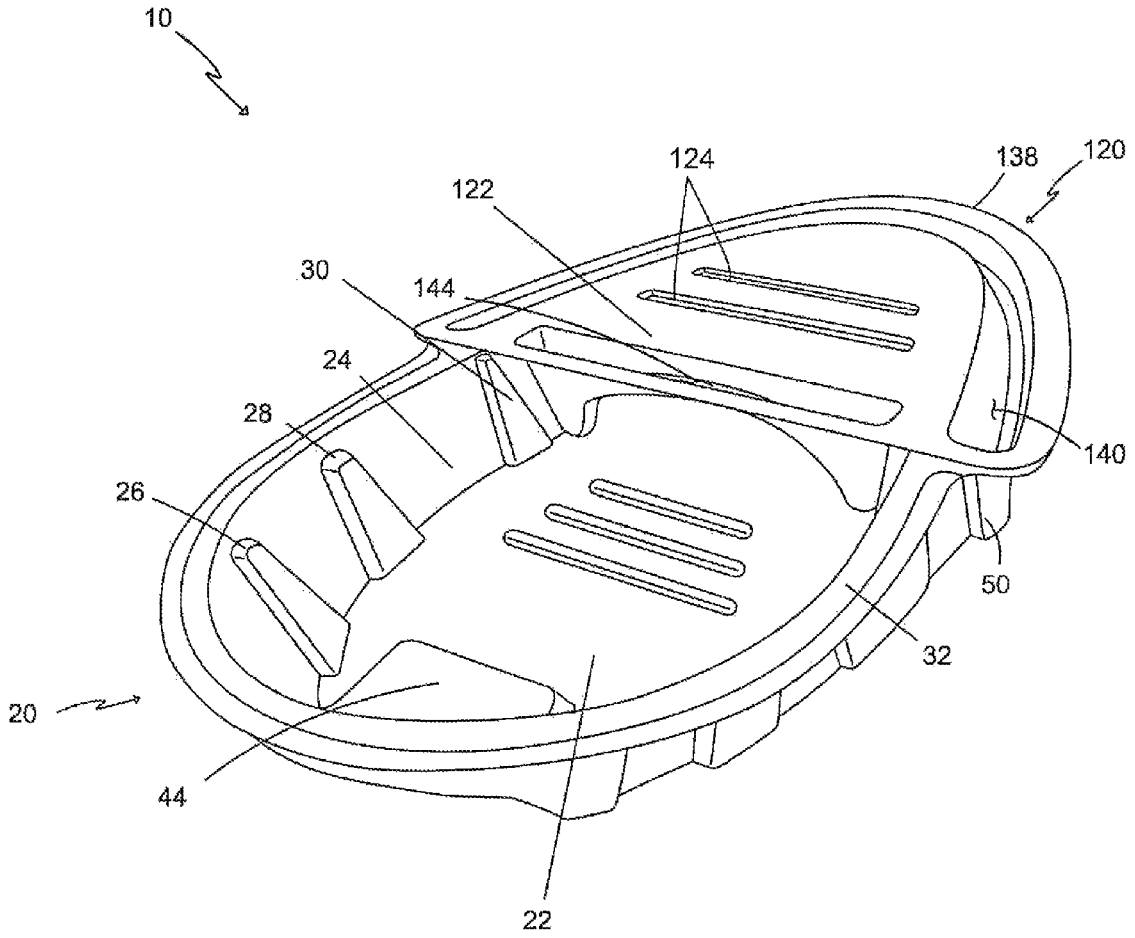
FIG. 4 represents a second isometric view of the assembled disposable bedpan.

As seen in FIGS. 3 and 4, cover 120 mounts upon bedpan 20 when assembled to support a user thereon, whereby cover base ridge 150 and cover base support 146 rest upon base 22. Bedpan 20 collects human waste including urine and feces or excrement. Disposable bedpan 10 is disposable, intended for a single use and is constructed of biodegradable materials.

Figure 5A:
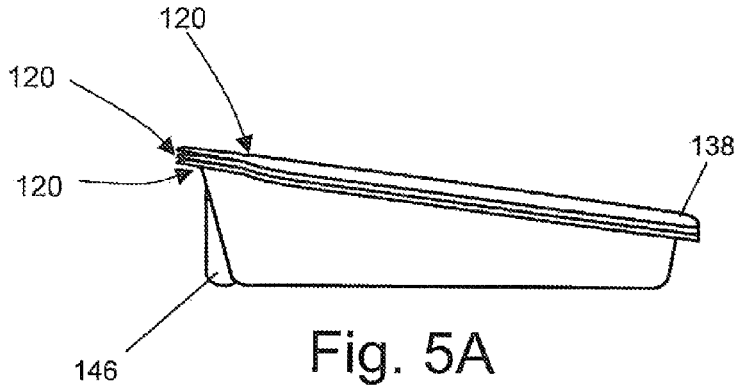
FIG. 5A is a side view of three stacked covers that are volumetrically efficient for carrying, transporting, and/or storage.

As seen in FIG. 5A, covers 120 are stackable upon one another to be volumetrically efficient for carrying, transporting, and/or storage, whereby a cover front top cavity 140 from a first cover 120 receives a cover base ridge 150 from a second cover 120.

Figure 5B:
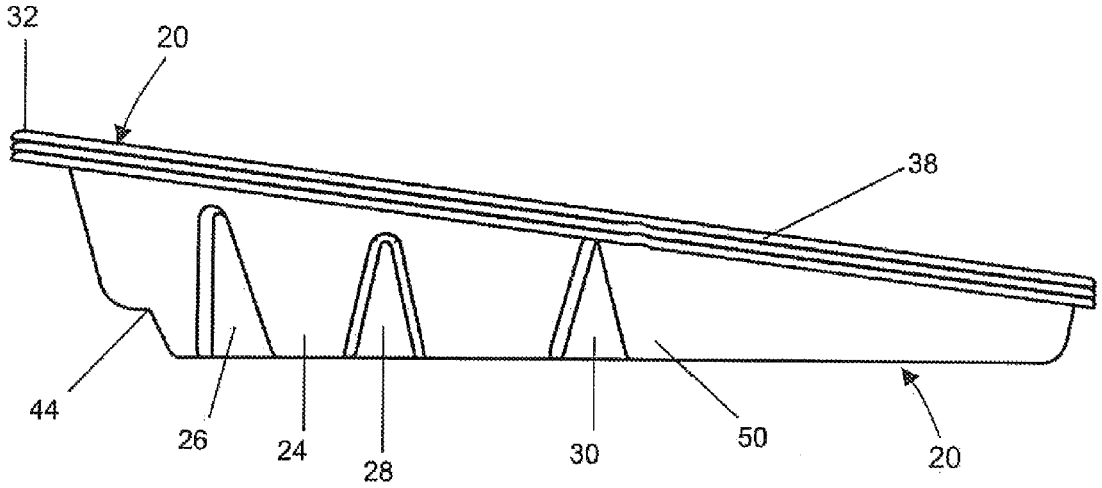
FIG. 5B is a side view of three stacked bedpans that are volumetrically efficient for carrying, transporting, and/or storage.

As seen in FIG. 5B, bedpans 20 are stackable upon one another to be volumetrically efficient for carrying, transporting, and/or storage, whereby a front top cavity 40 from a first bedpan 20 receives a front base support 50 from a second bedpan 20.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A disposable bedpan, comprising:

A) a bedpan having a base and an exterior sidewall, said exterior sidewall having longitudinal sides and lateral supports on said longitudinal sides, said bedpan is generally oval in shape and symmetrical, said bedpan further comprises a top ridge and a front ridge, said lateral supports protrude inwardly directly from said exterior sidewall and are tapered from said base towards said top ridge, said base comprises at least one ridge that extends perpendicularly across said base and protrudes inwardly from said base, said top ridge and said front ridge define a front top cavity, whereby said front ridge contours and extends along a perimeter section of said top ridge, said bedpan further comprises a front base support and a front bottom cavity that is defined between said base and said front base support, said bedpan further comprises a base support; and B) a cover comprising a cover base with at least one cover ridge that extends perpendicularly across said cover base, said cover further comprises a cover front ridge and a cover front top cavity defined between said cover front ridge and said cover base, said cover further comprises a cover cavity defined by a cover base support and a u-shaped cover base ridge, whereby said cover base support forms an arch, said cover is symmetrical and mounts upon said bedpan when assembled to support a user thereon, whereby said u-shaped cover base ridge and said cover base support rest upon said base and said bedpan collects human waste including urine and feces or excrement, and said bedpan and said cover are disposable, intended for a single use and are constructed of biodegradable materials.

2. The disposable bedpan set forth in claim 1, further characterized in that said cover is stackable upon another said cover to be volumetrically efficient for carrying, transporting, and storage, whereby said cover front top cavity from a first said cover receives said u-shaped cover base ridge from a second said cover.

3. The disposable bedpan set forth in claim 2, further characterized in that said bedpan is stackable upon another said bedpan to be volumetrically efficient for carrying, transporting, and storage, whereby said front top cavity from a first said bedpan receives said front base support from a second said bedpan.

* * * * *